US005746133A

United States Patent [19]

Widmer et al.

[11] Patent Number: 5,746,133

[45] Date of Patent: May 5, 1998

[54] POSTAGE METER WITH ROTOR MOVEMENT AND DIE COVER SENSOR

[75] Inventors: Benedikt Widmer, Bern; Martin Müller, Langenthal; Daniel Flückiger, Zäziwil; Christian Moy, Grossaffoltern; Philippe Chollet, Corcelles, all of Switzerland

[73] Assignee: Ascom Hasler Mailing Systems AG, Switzerland

[21] Appl. No.: 446,218

[22] Filed: May 22, 1995

[51] Int. Cl.[6] ..... B41F 1/66

[52] U.S. Cl. ..... 101/484; 101/76; 340/545; 340/825.36; 364/464.02

[58] Field of Search ..... 101/71, 76, 91, 101/484, 110; 340/545, 680, 825.36; 364/464.02

[56] References Cited

U.S. PATENT DOCUMENTS

| | | | |
|---|---|---|---|
| 4,016,467 | 4/1977 | Hallenbeck | 318/604 |
| 4,253,015 | 2/1981 | McFiggans et al. | 235/92 FP |
| 4,283,721 | 8/1981 | Eckert et al. | 340/680 |
| 4,421,023 | 12/1983 | Kittredge | 101/45 |
| 4,492,160 | 1/1985 | Clark et al. | 101/71 |
| 4,639,581 | 1/1987 | Berger et al. | 235/101 |
| 4,730,821 | 3/1988 | Flückiger | 270/58 |
| 4,774,881 | 10/1988 | Schubert | 101/91 |
| 4,807,139 | 2/1989 | Liechti | 364/464.02 |
| 4,864,505 | 9/1989 | Miller et al. | 364/464.02 |
| 4,887,807 | 12/1989 | Berger et al. | 271/171 |
| 5,038,153 | 8/1991 | Liechti et al. | 364/140 |
| 5,060,821 | 10/1991 | Berger et al. | 221/190 |
| 5,203,263 | 4/1993 | Berger et al. | 101/76 |
| 5,237,506 | 8/1993 | Horbal et al. | 364/464.02 |
| 5,276,844 | 1/1994 | Aebi et al. | 395/425 |
| 5,278,541 | 1/1994 | Wicht et al. | 340/636 |
| 5,301,116 | 4/1994 | Grünig | 364/464.02 |
| 5,340,965 | 8/1994 | Horbal et al. | 235/101 |
| 5,359,273 | 10/1994 | Flückiger | 318/794 |
| 5,363,760 | 11/1994 | Lindenmuller et al. | 101/91 |
| 5,389,863 | 2/1995 | Flückiger | 318/549 |

FOREIGN PATENT DOCUMENTS

| | | |
|---|---|---|
| 0062376 | 10/1982 | European Pat. Off. . |
| 0526139 | 2/1993 | European Pat. Off. . |
| 0526140 | 2/1993 | European Pat. Off. . |
| WO89/11134 | 11/1989 | WIPO . |

*Primary Examiner*—Ren Yan

*Attorney, Agent, or Firm*—Oppedahl & Larson

[57] ABSTRACT

A postage meter has an improved means of monitoring the position of the cover providing access to the print rotor. A mechanical latch and associated mechanism is provided responsive to a cam on the print rotor and responsive to the movement of the cover, and the mechanism has an electrical sensor output to the processor of the postage meter. In the event that the cover is opened at a time when the rotor is away from its home position, for example at a time when the power to the meter has failed, the latch enters a latched state. Upon the restoration of power the meter determines if the rotor is away from its home position, and if it is, the meter inspects the sensor output to determine if the latch has been caused to enter its latched state. This condition is annunciated, for example by rendering the meter incapable of printing postage. The meter has a hardware circuit external to the processor which receives as an input at least one signal indicative of rotation of the print rotor, and which counts the rotations. The circuit also receives a reset signal from the processor which, it is assumed, will be provided if the processor is functioning normally but will not be provided in the event of processor malfunction. If the counter reaches a predetermined threshold the circuit halts the print motor.

4 Claims, 13 Drawing Sheets

POSTAGE METER WITH ROTOR MOVEMENT AND DIE COVER SENSOR

SPECIFICATION

The invention relates generally to postage machines (also called franking machines) and relates particularly to sensors sensing the opening of the die cover at a time when the print rotor is not in its home position, and sensing rotor movement.

BACKGROUND

The design of a postage meter represents a continuing warfare with those who would tamper with a meter to obtain free postage. The postal authorities expend much effort attempting to identify possible avenues of attack, and the designers of postage meters are held to the task of guarding against each avenue as it is identified, even where the likelihood of successful attack may be quite small.

One standard design measure taken to minimize tampering is the provision of a secure housing around the print rotor. The secure housing minimizes access to the print indicia of the postage meter. It is not, however, workable to have a continuous secure housing, since there are some conditions under which the user has a legitimate need to gain access to the print rotor. For example, it may be necessary to insert or remove an advertising die plate. As another example it may be necessary to change a mail type die or to adjust date wheels. Thus, there is a need for a cover in the secure housing that can be opened to permit access to a portion of the rotor, and such covers are commonly found in rotary postage meters.

The provision of a cover that may be opened to gain access to a portion of the rotor then gives rise to the question whether it might be possible to gain access to a portion of the rotor (the value print wheels, for example) that users are not supposed to be able to reach. The usual concern is that a user might trigger a franking (printing) cycle and then cut the electric power to the meter so as to halt the print rotor at a time when its value wheels are uppermost and accessible when the cover is opened. If the user then opens the cover it is hypothesized that it might be possible to tamper with the value wheels.

Several approaches for protecting against this possibility are set forth in a copending patent application entitled Tamper-resistant Postage Meter, application Ser. No. 08/400,335, filed Mar. 7, 1995, and assigned to the same assignee as that of the present application, which is incorporated herein by reference. These approaches include providing a radial or axial cam (or both) engaging a lock on the rotor such that the cover cannot easily be opened except when the rotor is in its home position. Still other approaches include providing an electrical switch that yields an output at times when the cover is open.

It has been suggested that these approaches might nonetheless be overcome by a sufficiently knowledgeable and persistent wrongdoer. For example, it has been suggested that someone might cut power to a meter during a printing cycle, pry the cover open in a way that overcomes the cam lock without leaving visible traces of prying, fiddle with the value wheels, close the cover again, restore power to the meter, and then print postage value without paying for it.

It is thus of interest to develop a postage meter with a greatly improved sensing mechanism that will sense the event of the cover having been opened at a time when the rotor is away from its home position, even if the meter was unpowered during the time that the cover was open.

A further important aspect of meter design is provision for the possibility of the processor running amok. For example, suppose the postage meter is of a type in which the processor generates an output to cause the print rotor to rotate, and generates a different output to bring the print rotor to a halt. In such a meter, the question arises what would happen if the processor were to run amok after generating the output that causes the print rotor to commence rotation. There is some possibility, however, small, that the output that causes the print rotor to rotate would remain extant, and that the meter would commence printing postage in an unending way. This would permit printing of arbitrarily large sums of postage without accounting for the postage.

It is thus desirable to have a postage meter with a provision that greatly reduces the risk that postage would be printed without being accounted for, due to the processor running amok after issuing a command to commence the printing of postage.

SUMAMRY OF THE INVENTION

A postage meter has an improved means of monitoring the position of the cover providing access to the print rotor. A mechanical latch and associated mechanism is provided responsive to a cam on the print rotor and responsive to the movement of the cover, and the mechanism has an electrical sensor output to the processor of the postage meter. In the event that the cover is opened at a time when the rotor is away from its home position, for example at a time when the power to the meter has failed, the latch enters a latched state. Upon the restoration of power the meter determines if the rotor is away from its home position, and if it is, the meter inspects the sensor output to determine if the latch has been caused to enter its latched state. This condition is annunciated, for example by rendering the meter incapable of printing postage.

The meter has a hardware circuit external to the processor which receives as an input at least one signal indicative of rotation of the print rotor, and which counts the rotations. The circuit also receives a reset signal from the processor which, it is assumed, will be provided if the processor is functioning normally but will not be provided in the event of processor malfunction. If the counter reaches a predetermined threshold the circuit halts the print motor.

DESCRIPTION OF THE DRAWING

The invention will be described with respect to a drawing in several figures, of which.

DETAILED DESCRIPTION

Figure 1:
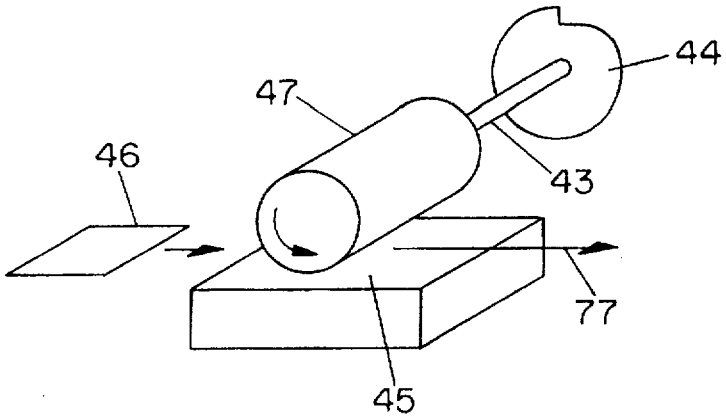
FIG. 1 is a simplified cutaway perspective view of a postage meter.
Figure 2:
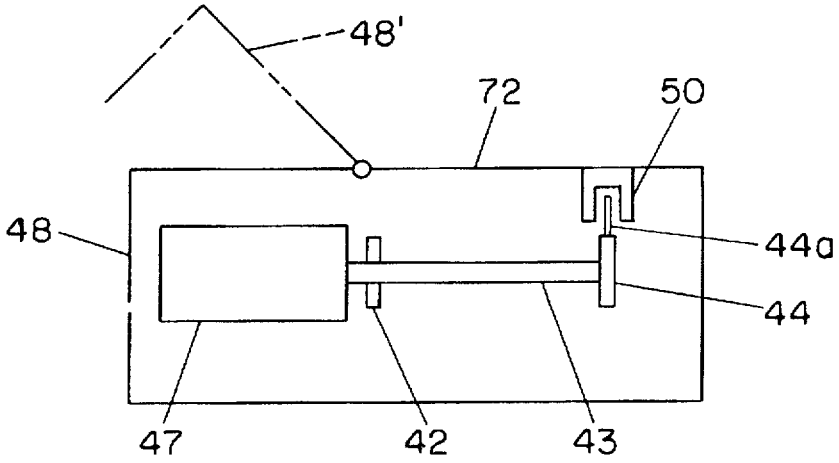
FIG. 2 is a simplified side cross sectional view of a postage meter.

Turning first to FIG. 1, what is shown is a simplified cutaway perspective view of a postage meter. The print rotor 47 may be seen, which rotates in the direction shown to print postage value on a mail piece 46 which moves along a paper path 77, defined by surface 45. Rotor 47 is attached to shaft 43 and is also rotationally coupled to tapered sensing cam 44. Turning now to FIG. 2, what is shown is a simplified side cross sectional view of the postage meter. Hinged cover 48 is visible, which may be opened to phantom position 48'. Also visible in FIG. 2 is a rotor home position sensor 50 which optically engages a cam follower 44*a* which mechanically engages cam 44. Those skilled in the art will appreciate that obvious variations could be used for this sensor, including Hall-effect and reed switch sensors, or mechanical switches actuated by cams or cam followers, all without departing from the invention. The teachings of copending patent application Ser. No. 08/014,658, filed Feb. 8, 1993, assigned to the same assignee as that of the present application, which is incorporated herein by reference, may also be drawn upon.

Figure 4:
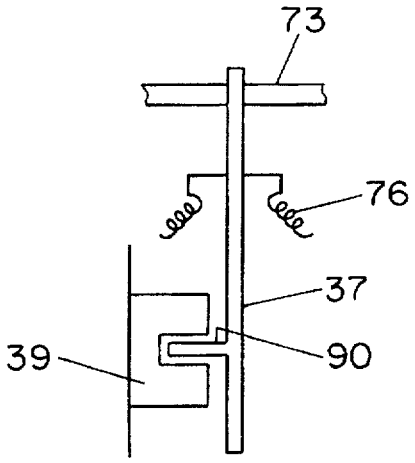
FIG. 4 shows a cover movement sensing switch.
Figure 3:
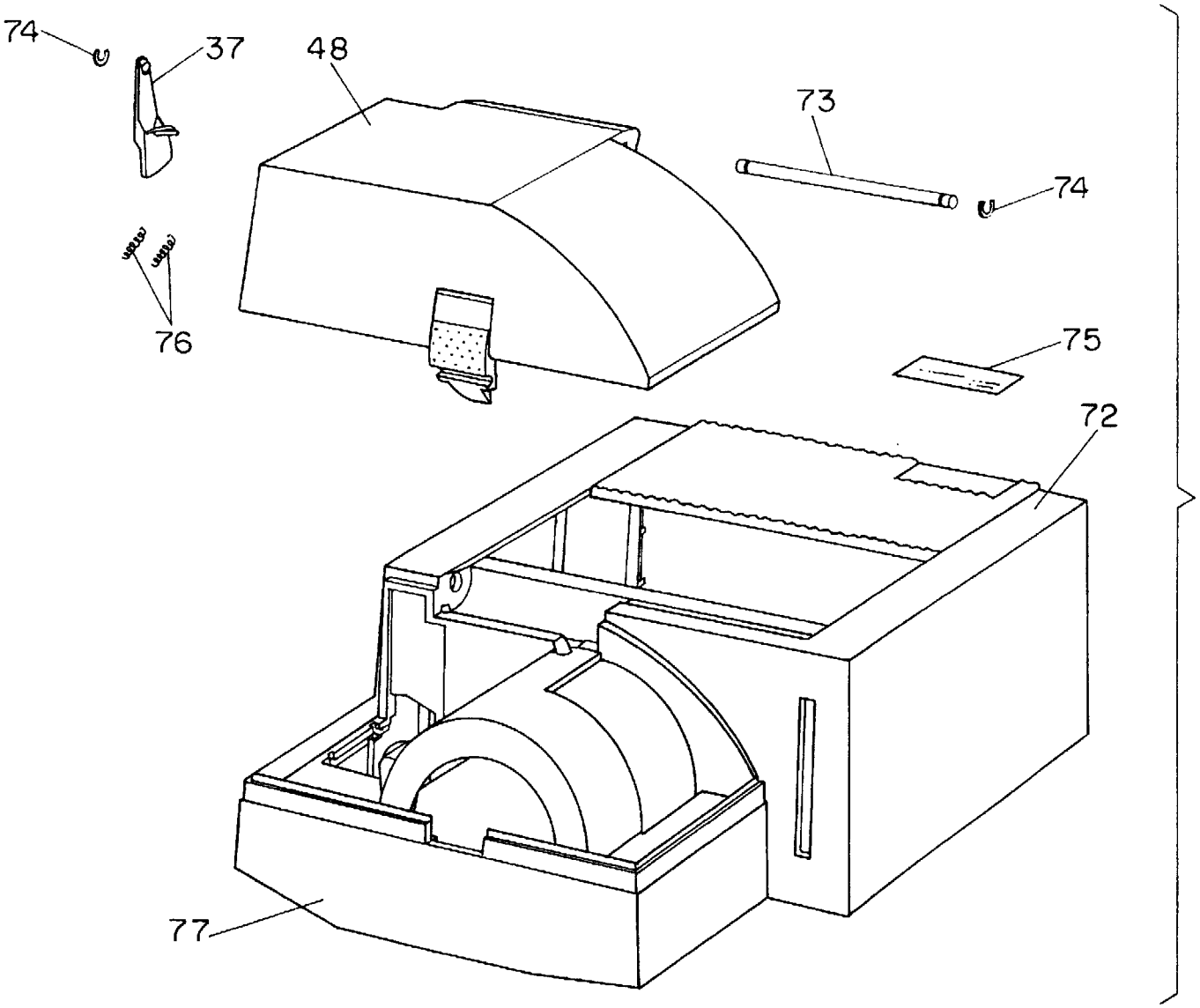
FIG. 3 is a perspective exploded view of part of the secure housing of a postage meter.

FIG. 3 is a perspective exploded view of part of the secure housing of a postage meter. The housing 72 has a front portion 77 which largely surrounds the print rotor. Hinge pin 73 movably fixes cover 48 to housing 72. Logo 75 identifies the meter. Circlips 74 fix the pin 73. A lever 37 is held in one position (counterclockwise in FIG. 3) when the cover 48 is closed, and is otherwise urged in a second position (clockwise in FIG. 3) by springs 76 when the cover 48 is not closed. Lever 37 has a feature 90, not visible in FIG. 3, which selectively engages a sensor composed of an LED (light-emitting diode) and phototransistor, also not visible in FIG. 3. FIG. 4 shows a cover movement sensor 39 which optically engages feature 90. Pin 73 and springs 76 are also visible. The lever 37 rotates out of the page when the cover opens and into the page when it closes; the springs 76 urge the lever 37 out of the page.

Figure 24A:
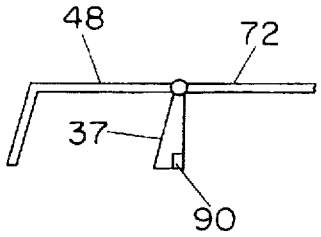
FIGS. 24*a*, 24*b*, and 24*c* show the mechanical relationship between the cover 48 and the cover lever 37 in closed, slightly open, and fully open positions respectively.
Figure 24B:
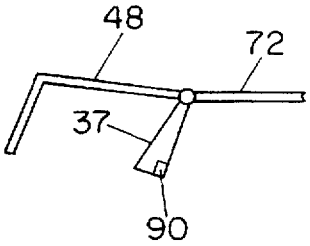
Figure 24C:
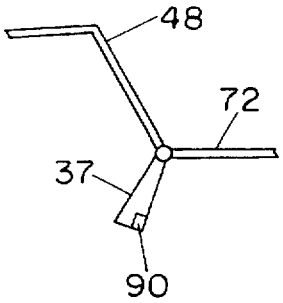

The relative movement of the cover 48 and lever 37 is shown in more detail in FIGS. 24*a*, 24*b*, and 24*c*. Abutment features are provided at the pivot point of contact between cover 48 and lever 37. When cover 48 is closed, as in FIG. 24*a*, then the lever 37 is in its rearmost position, rotated counterclockwise in FIG. 24*a* against the urging of tension springs omitted for clarity in FIG. 24*a*. Feature 90 allows light to pass in sensor 39, also omitted in FIG. 24*a*. When cover 48 opens slightly, as shown in FIG. 24*b*, the lever 37 rotates with it. Feature 90 moves into optical engagement with sensor 39. When cover 48 opens fully, as shown in FIG. 24*c*, the lever 37 does not rotate further but remains positioned with feature 90 in optical engagement with the sensor 39.

Figure 5:
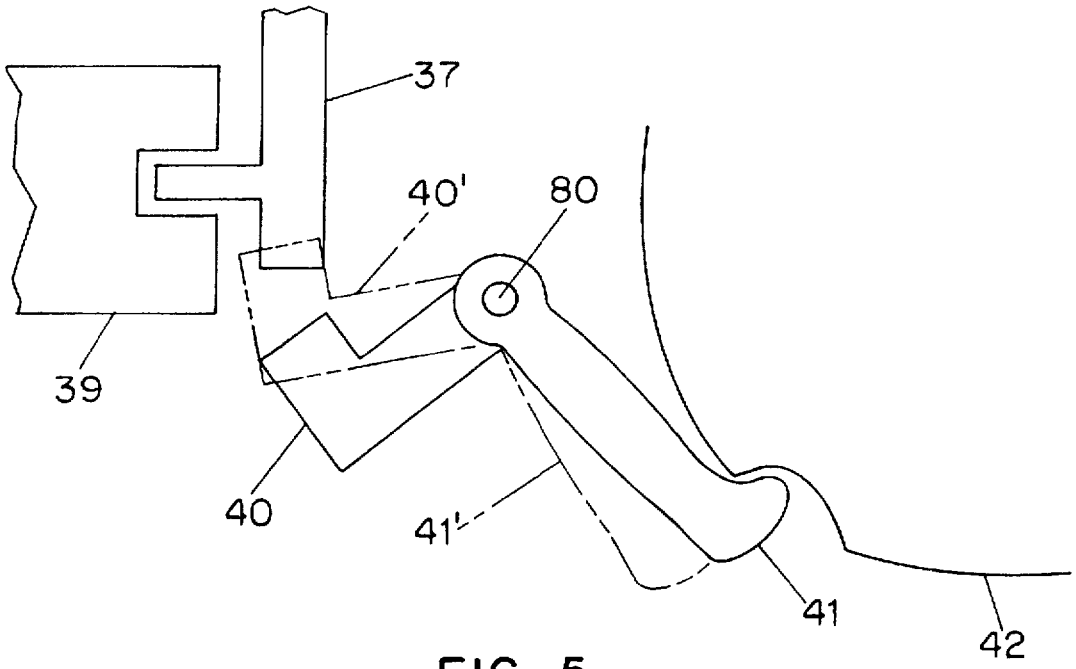
FIG. 5 shows a cam and cam follower arrangement together with a portion of a latch.

FIG. 5 shows a cam 42 and cam follower 41 together with a portion of a latch 40, which latch 40 may also be referred to as a bar or bolt. Cam 42 is shaped with a concavity that lines up with the cam follower 41 when the rotor is in its home position. When the rotor is away from its home position the follower 41 is moved to a position shown in phantom as 41'. Follower 41 rotates on a pivot 80 and is urged counterclockwise in FIG. 5 by a spring, omitted for clarity in FIG. 5. Also rotating on pivot 80 is the latch or bar or bolt 40. As will be discussed at some length below, the latch 40 is generally in any of three positions—the lowest position 40 as shown in FIG. 5, an intermediate position 40' as shown in phantom in FIG. 5 (in which the latch is abutted against the lever 37), or a highest position 40" not shown in FIG. 5. If the rotor is not in the home position and if the cover is opened, the latch 40 moves upward into position 40". In that position the latch ensures that sensor 39 generates a signal indicative of the cover having been open, and the latch remains in that position even if the cover is closed. Those skilled in the art will appreciate that while the apparatus of FIG. 5 shows a one-sided cam that uses a return spring, it would be possible to eliminate the spring if a two-sided cam were used, all without departing from the invention. Likewise while a radial cam is shown, an axial cam could be used, again without departing from the invention. Similarly while the design shown uses a concavity when the rotor is in its home position, some other shape such as a convex region could be used with appropriate adaptations to the cam follower and other moving parts. Latch position 40" is shown in more detail below in connection with FIG. 26*c*.

Figure 6:
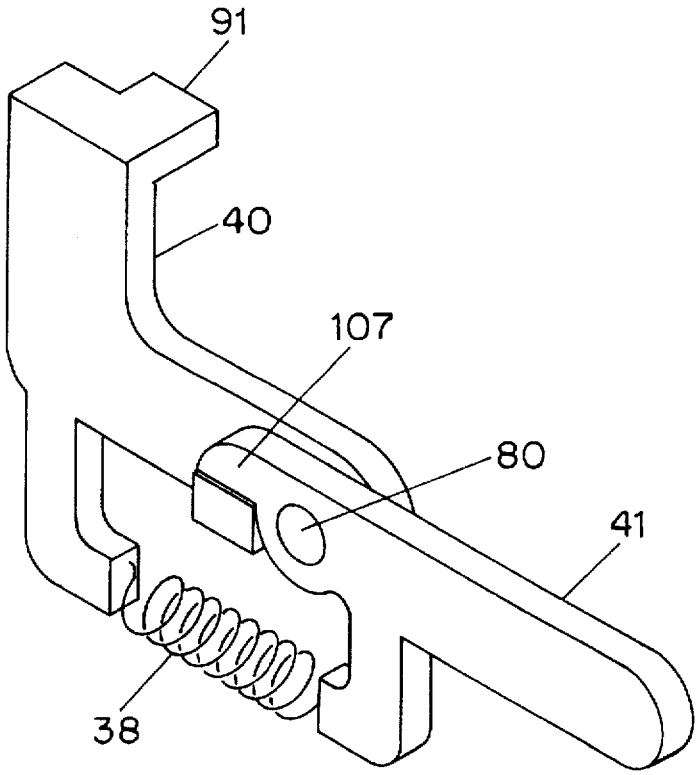
FIG. 6 shows a perspective view of a portion of the follower and latch arrangement of FIG. 5.

FIG. 6 shows a perspective view of one embodiment of a portion of the follower and latch arrangement of FIG. 5. Importantly, abutment area 107 is provided so that when follower 41 is rotated counterclockwise in FIG. 6 (that is, when the rotor is in its home position) the latch 40 is forced to rotate counterclockwise as well. On the other hand, when the rotor is out of its home position the follower rotates clockwise. Compression spring 38 urges latch 40 clockwise.

Figure 9:
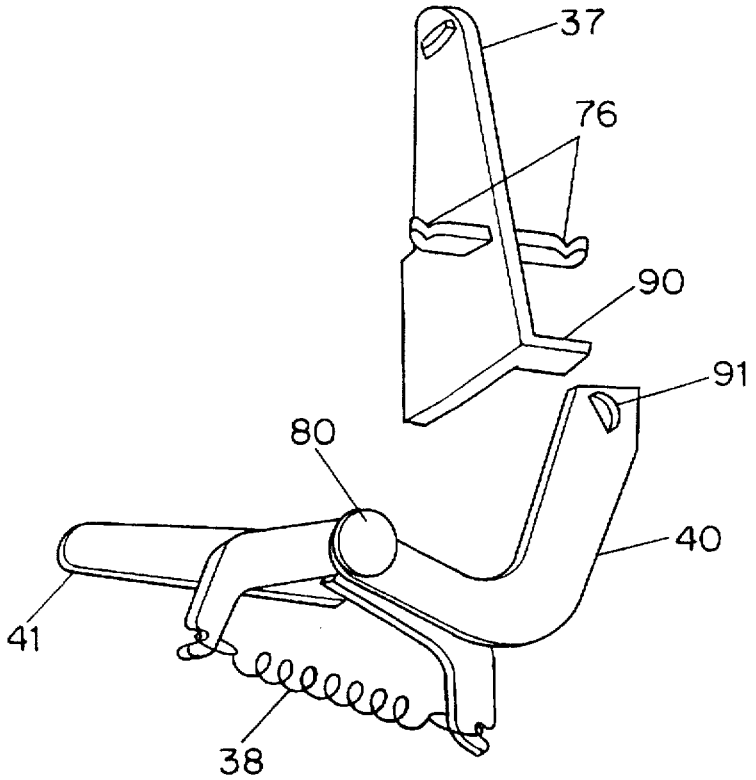
FIG. 9 shows the cam follower, blocking bar, and cover lever in a perspective view with greater detail.

Turning now to FIG. 9, the cam follower 41 and blocking bar 40 are shown in perspective view from inside the postage meter looking toward the front upper left corner of the meter. Cover lever 37 may be seen, with hooks 76*a* to hold tension springs 76, omitted for clarity in FIG. 9. Cam follower 41 and blocking bar 40 rotate on pivot 80, and in this embodiment they are biased relative to each other by tension spring 38 rather than the compression spring of FIG. 6. In FIG. 9 the feature 90 is visible, which allows light to pass within the cover sensor 39 (omitted for clarity in FIG. 9) when the cover is closed. When the cover opens, the lever 37 is permitted to rotate into the page, urged by springs 76. This moves feature 90 out from the cover sensor 39. Light passes from the LED (light-emitting diode) of the sensor to the phototransistor of the sensor.

Figure 26A:
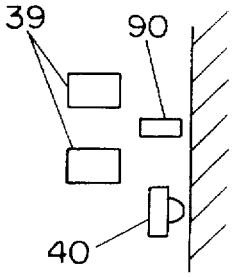
FIGS. 26*a*, 26*b*, and 26*c* show the mechanical relationship between the cover sensor, the cover lever, and the blocking bolt during a printing cycle when the rotor cover is improperly opened.
Figure 26B:
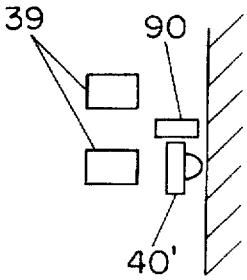
Figure 26C:
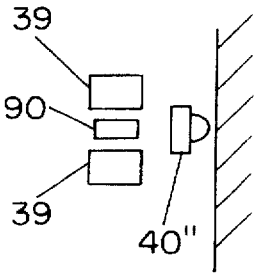

When the rotor rotates, cam follower 41 is rotated counterclockwise in FIG. 9. As will be described in more detail below, abutments in the linkage between 41 and 40 permit latch 40 to rotate counterclockwise as urged by tension spring 38. Assuming the cover is closed, then lever 37 is positioned directly above latch 40, and latch 40 only moves upward so far as to come into abutment with lever 37. This position, termed 40', is also shown in FIGS. **25*b* and 26*b*. Alternatively, if the cover is open, then lever 37 is positioned into the page in FIG. 9, and thus latch 40 is permitted to move further upward in FIG. 9. This position, termed 40", is also shown in FIG. 26*c***.

Figure 10:
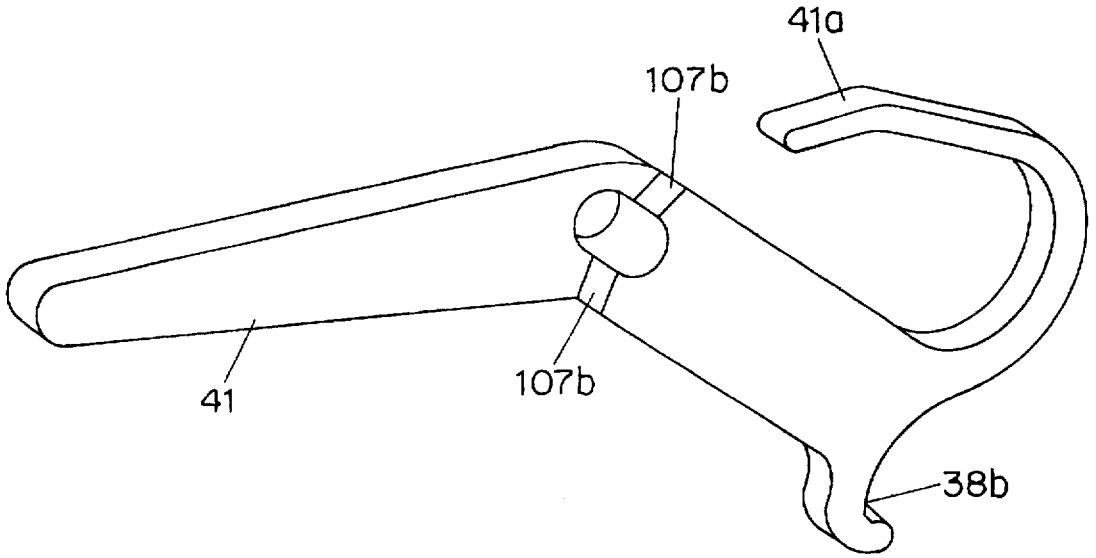
FIG. 10 shows in perspective view the cam follower including an integral spring.
Figure 11:
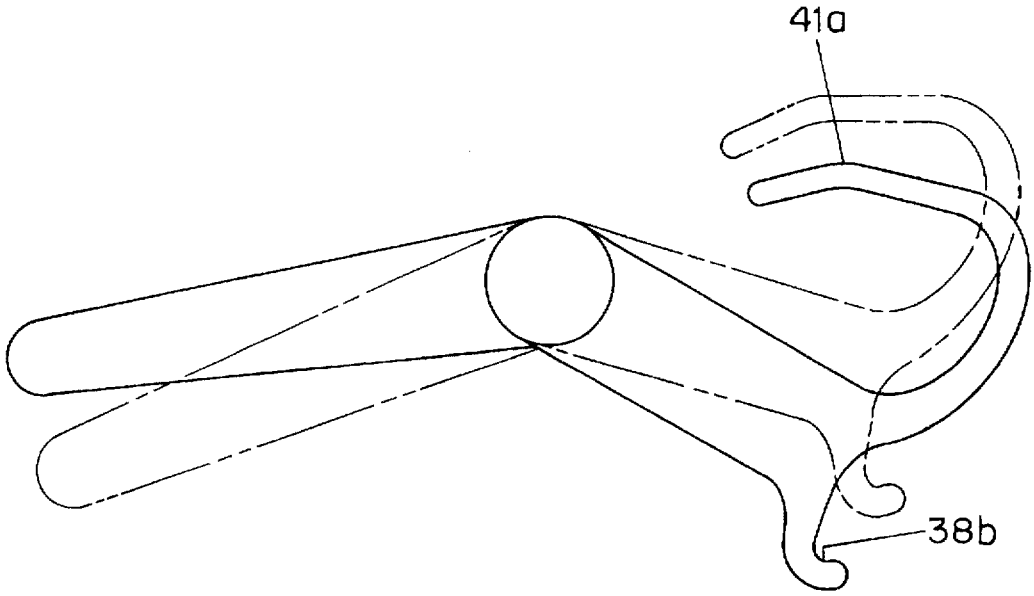
FIG. 11 shows in plan view the cam follower and, in phantom, its configuration when the spring is compressed.
Figure 12:
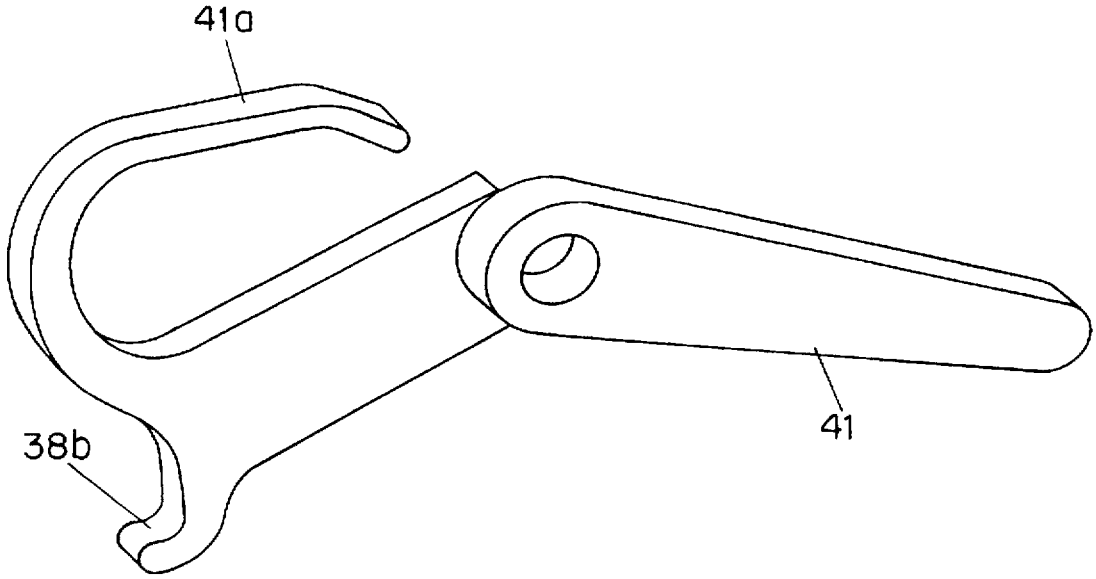
FIG. 12 shows the cam follower in a different perspective view.

FIG. 10 shows the cam follower 41 of FIG. 9 in perspective view. Hook **38*b* engages one end of tension spring 38. Portion 41*a* serves as an integrally formed return spring urging cam follower 41 toward the cam. Abutment region 107*b* engages mechanically with a corresponding abutment region in the latch 40, permitting a limited range of angular motion of the latch 40 relative to the follower 41. FIG. 11 shows the cam follower 41 with the rotor in its home position, and also shows in phantom the cam follower 41 when the rotor is away from its home position; the integral spring 41*a* is compressed in this position. FIG. 12 shows the cam follower 41** in a perspective view as seen from the upper front left corner of the postage meter.

Figure 13:
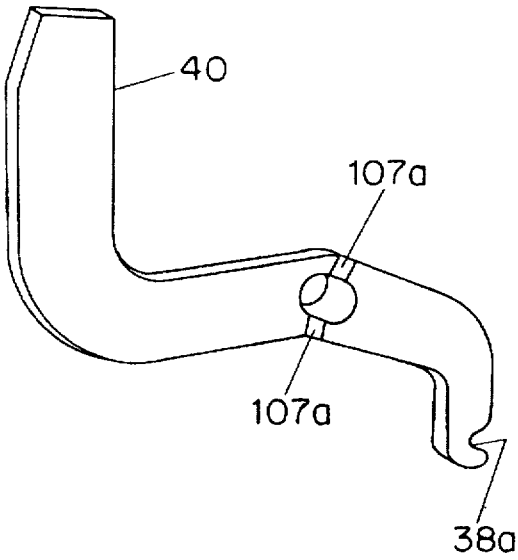
FIGS. 13 and 14 show the blocking bar 40 in two different perspective views.
Figure 14:
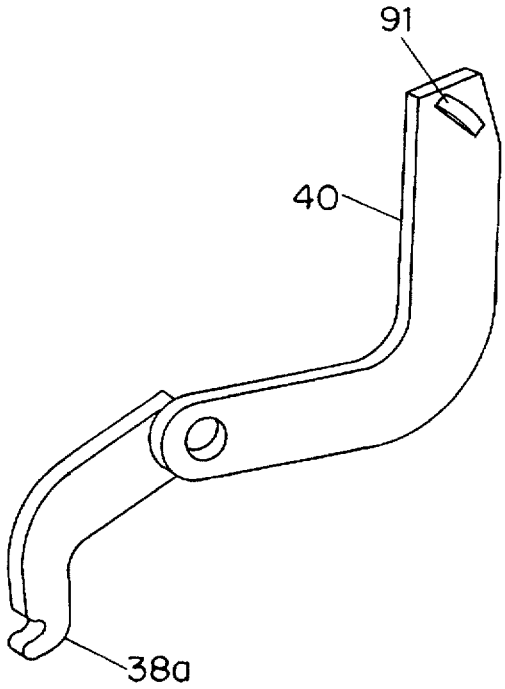
Figure 15:
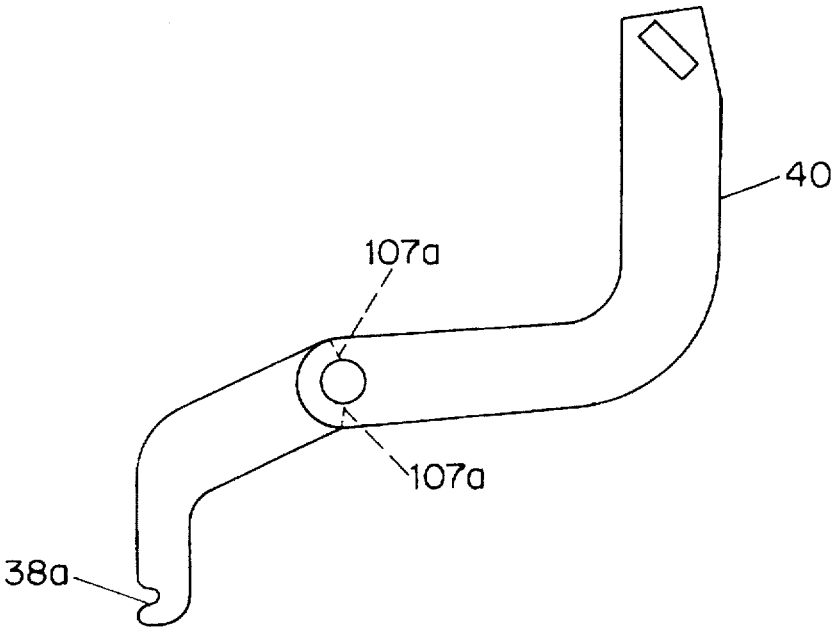
FIG. 15 shows the blocking bar 40 in a plan view.

FIGS. 13 and 14 are front and rear perspective views, respectively, of the latch 40. Abutment regions **107*a* engage with the aforementioned abutment regions 107*b*. Hook 38*a* holds the other end of tension spring 38. Feature 91 provides a controlled surface of sliding contact with the nearby chassis. FIG. 15 is a rear plan view of latch 40, showing abutment regions 107*a*** in phantom.

Figure 25A:
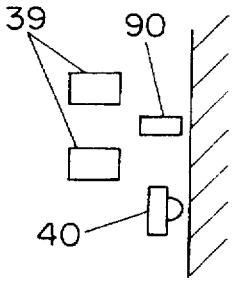
FIGS. 25*a*, 25*b*, and 25*c* show the mechanical relationship between the cover sensor, the cover lever, and the blocking bolt during a normal printing cycle.
Figure 25B:
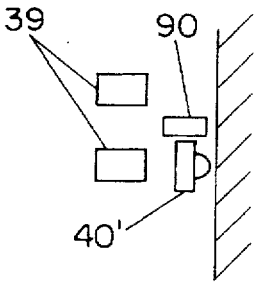
Figure 25C:
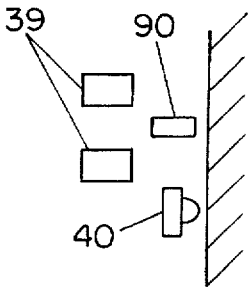

Turning now to FIG. **25*a*, what is shown in cross section view (seen from the right side of the postage meter) are the sensor 39, the feature 90 of cover lever 37, and the latch 40. The sensor 39 may be an LED-phototransistor sensor, with the LED above and the phototransistor below or vice versa. In FIG. 25*a* the feature 90 is to the left of the sensor 39, and does not block light. From this it follows necessarily that the cover is closed, as was discussed in connection with FIGS. 24*a*, 24*b*, 24*c*, and 24*d*. In FIG. 25*a* it may also be seen that the latch 40** is in its lowest position. From this it follows necessarily that the rotor is in its home position.

When the rotor moves out of its home position the cam follower is deflected and latch 40 is permitted to move upwards. Latch 40 moves up far enough to abut against the lowest surface of latch 37 (here, feature 90). When the rotor finishes its print cycle and returns to its home position, as shown in FIG. **25*c*, the latch 40** is again forced downward to the position shown, due to the cam follower rotating to follow the depression in the cam.

FIGS. **26*a*, 26*b*, and 26*c* show what happens when the cover is opened during a printing cycle. FIG. 26*a* shows the state of affairs prior to the start of the print cycle, and looks just like FIG. 25*a*. Later, the print rotor rotates out of its home position and the latch 40 is urged upward until it abuts the bottom of feature 90 as in FIG. 26*b*. Now, suppose the cover is opened at a time when the rotor is out of its home position. (This will presumably happen because the meter lost electric power, after which time the user attempts to open the rotor cover.) Feature 90 moves leftward in FIG. 26*c*. As a result, latch 40 is permitted to move upward to position 40". Subsequent closing of the cover merely slides the lever 37 and feature 90 to the right in FIG. 26*c*, striking the side of the latch 40 in position 40"**.

Even after electric power is restored, the positions shown in FIG. **26*c* do not change. The processor of the postage meter notes, upon power-up, that the rotor is not in its home position and that the cover sensor does not have the feature 90** interposed therein. The processor then reaches a state in which it will not reenergize the motor that rotates the rotor, and instead refuses to print any more postage.

Those skilled in the art will appreciate that the optical linkage between the feature 90 and the sensor 39 could be rather arbitrarily selected so that feature 90 blocks light when the cover is open, and allows light to pass when the cover is closed, or vice versa, without departing from the invention. The arrangement set forth here is thought to be preferable.

Figure 7:
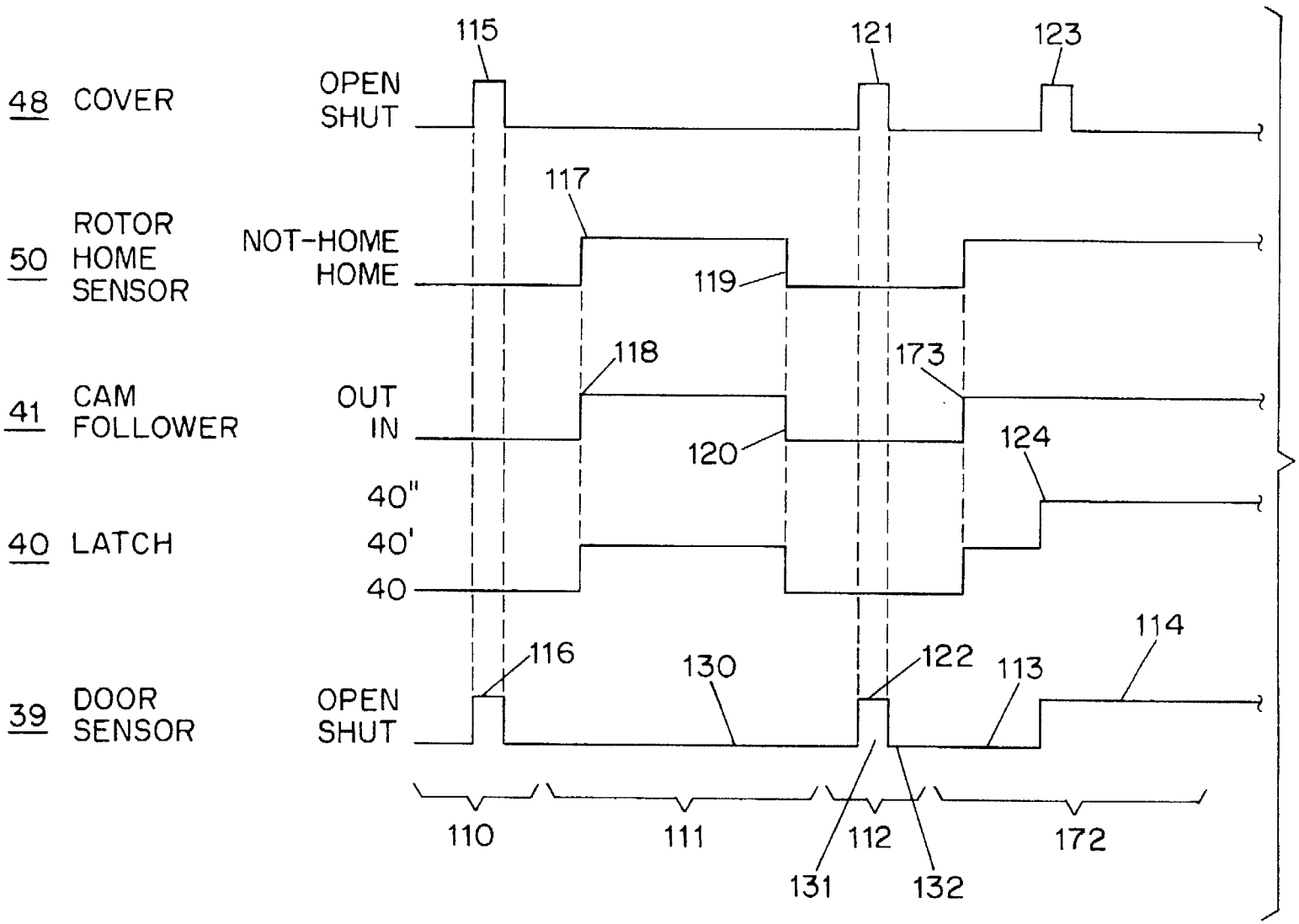
FIG. 7 shows typical mechanical positions and sensor outputs during normal and abnormal operating conditions.

FIG. 7 shows typical mechanical positions and sensor outputs during normal and abnormal operating conditions. The first line shows the cover 48 (door) position. The second line shows the output of the home-position sensor 50. The third line shows the position of cam follower 41. The fourth line shows the position of the latch 40. The fifth line shows the output from the door sensor switch 39.

Time interval 110 represents a time when no postage is being printed. The cover is opened at 115, which might happen because the user needs to insert or remove an advertising die or, in some postage meters, to adjust the date wheels of the meter. This is noted at the door sensor at 116. The output of the door sensor 39 goes to the processor of the postage meter, and among other things the processor will not permit the printing of postage while the door is open.

Interval 111 shows a typical franking cycle. The home sensor 50 shows rising edge 117 and falling edge 119 indicative of the start and end of the print cycle. The cam follower 41 moves back and forth at 118 and 120. Those skilled in the art will appreciate that the invention does not require absolute matching between 117 and 118, or between 119 or 120.

Interval 112 shows another time between franking cycles, during which the user might choose to open the cover.

Now in interval 172 the latching action of the invention may be seen. At 173 the franking cycle has begun and the follower 41 has been moved to its non-home follower position. This urges the latch 40 into position 40'. So long as the cover 48 remains shut the latch remains in position 40' and does not move into its latched position 40".

Now suppose cover 48 is opened as shown at 123. The result is that the latch 40 moves to its latched position 40" as at 124. This latched position persists indefinitely, because the processor does not return the rotor to its home position. Because of the processor's programming, the result is that the latched position remains latched indefinitely (until the meter is serviced by authorized personnel). Even if the cover is closed completely, the latched position 40" persists, because the lever 37, blocked by the latch 40, is unable to return to its position in which the feature 90 clocks light in the sensor 39.

Figure 8:
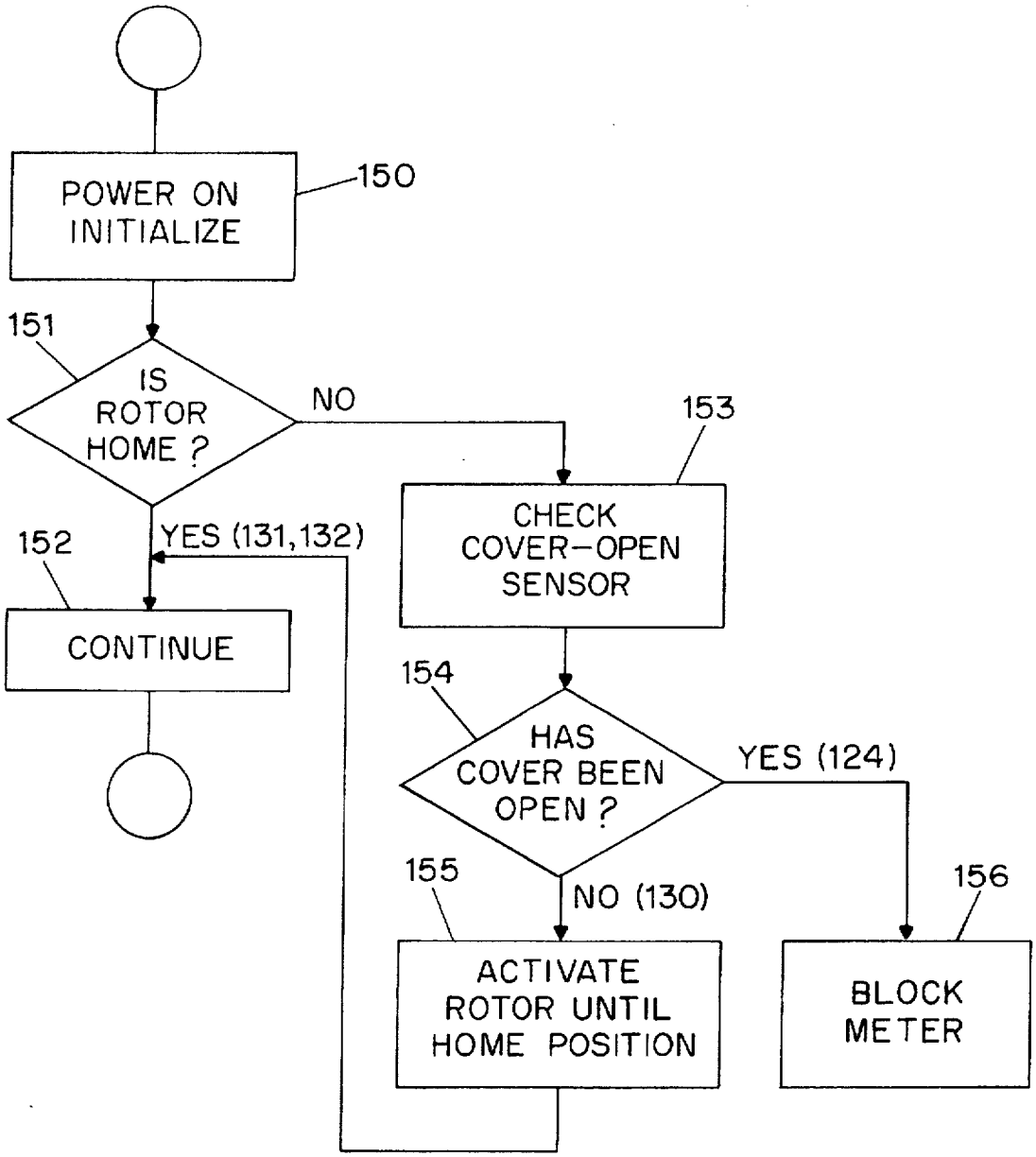
FIG. 8 shows a flowchart of the operation of the postage meter according to the invention.

FIG. 8 shows a flowchart of the operation of the postage meter according to the invention. First power is applied and the processor starts its initialization routines at 150. A test is made at sensor 50 to determine if the rotor is in its home position. If the rotor is in its home position (and in the overwhelming majority of cases it is expected this will be the case) then initialization continues at 152 and the meter proceeds to normal operation. This might happen, for example, at time 132 or 131 in FIG. 7. It will be appreciated that so long as the rotor has been in the home position since the last time power was lost, then it is not of concern for the cover to be open as at time 131.

In some relatively rare cases the rotor test at 151 may indicate that the rotor is not in the home position. In such a case execution proceeds to box 153. The question then arises, then, whether the cover-open sensor 39 has light from its LED striking its phototransistor. If the answer is no, then execution proceeds to box 155, where the processor activates the rotor motor to rotate it to its home position. The assumption at this point is that the loss of power may not have been the fault of the user and is no particular indication of meter tampering. This might happen due to a power loss at, say, time 130 in FIG. 7.

If the sensor 39 does have light from its LED striking its phototransistor, then this means the latch 40 has been latched and thus that the cover 48 was opened at some time when the rotor was not in the home position. Execution proceeds to box 156 where the meter is blocked from further printing of postage. This could result from power failing at time 113, followed by power being restored at time 114.

Figure 16:
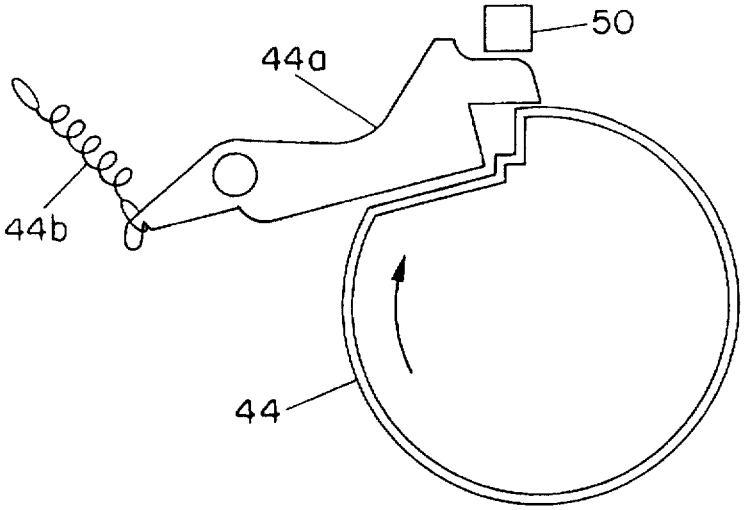
FIG. 16 shows the rotor cam 44, the cam follower 44*a*, and rotor home position sensor 50, in cross section view.

The rotor home position cam 44 and associated parts will now be described in more detail, as shown in FIG. 16. Cam 44 is operatively coupled with the print rotor, for example by being fixed on its axle. FIG. 16 shows the cam 44 in a view from the rear of the postage meter, so that rotation occurs clockwise. A cam follower **44*a* rides on the cam 44, urged toward it by tension spring 44*b* the other end of which is hooked to the chassis. In the position shown in FIG. 16 the rotor is in its home position, and the follower 44*a* is not blocking the light in LED-phototransistor sensor 50. The cam 44 and follower 44*a*** may be characterized as providing a sawtooth and pawl, the sawtooth defined by a radial region associated with the rotor home position, the pawl defined by a portion of the cam follower, so that when the rotor reaches its home position the pawl drops into the sawtooth, thereby blocking any retrograde rotation of the rotor.

Figure 17:
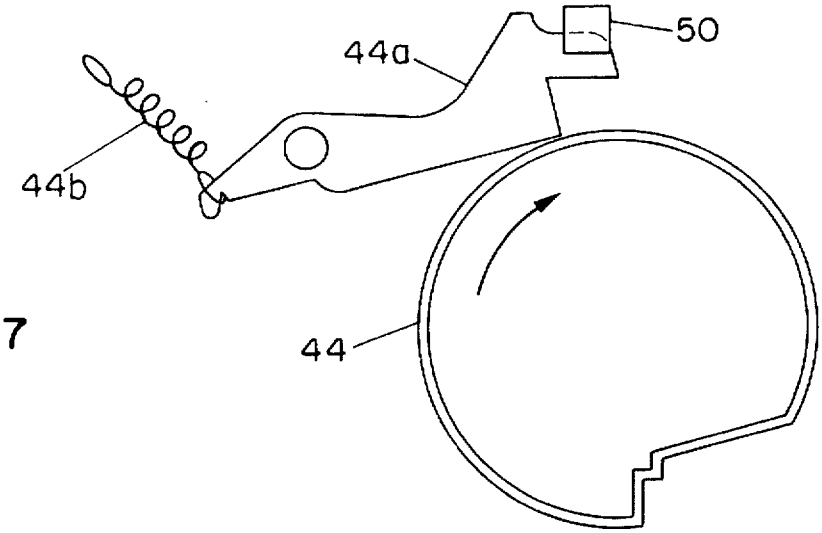
FIG. 17 shows the rotor cam of FIG. 16 but in the middle of a postage printing cycle.
Figure 18:
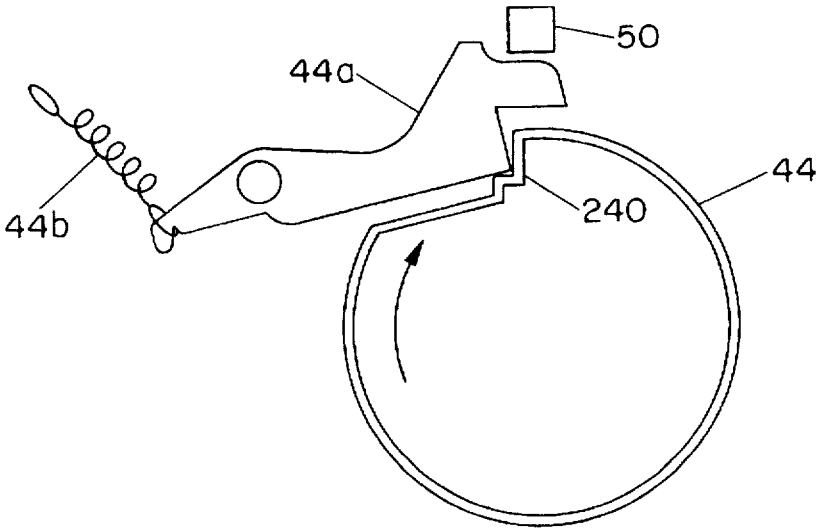
FIG. 18 shows the rotor cam of FIG. 16 but at the end of a postage printing cycle.

FIG. 17 shows the situation when the rotor is half way through a print cycle. Follower **44*a* is deflected upwards and blocks the light in the sensor 50. FIG. 18 shows the situation when the rotor has nearly completed a full cycle. The follower 44*a* drops down to a small knee 240 and no longer blocks the light in sensor 50. If the rotor rotates a small additional amount then the follower 44*a* drops all the way down and once again looks like the situation in FIG. 16**. In this way, retrograde rotation of the rotor is blocked at each of two positions.

Figure 19:
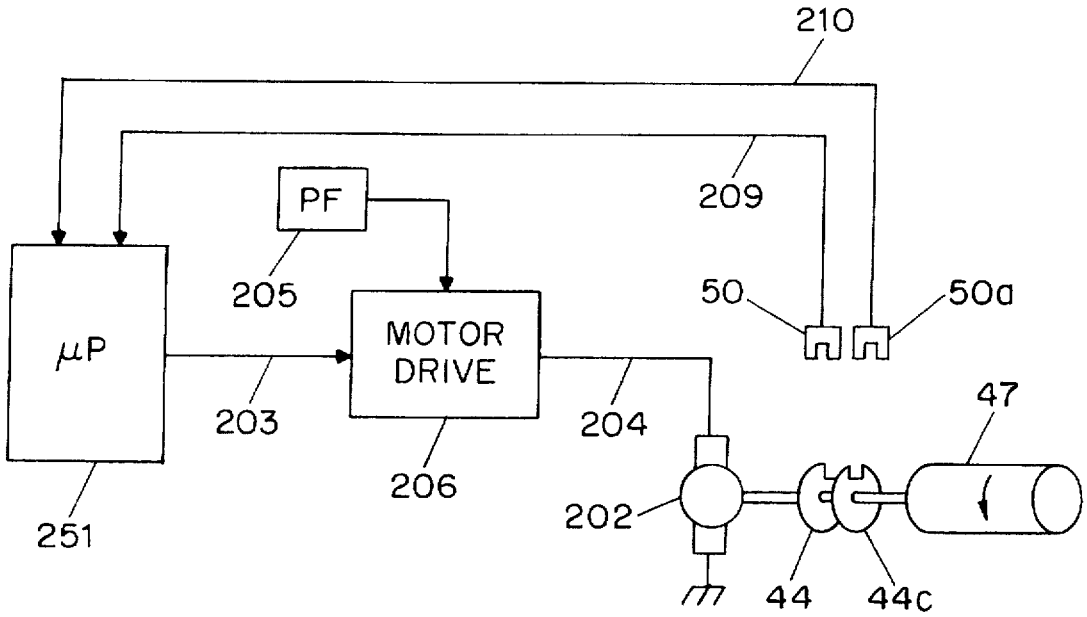
FIG. 19 shows the control loop for a postage meter.

FIG. 19 shows the control loop for the rotor in more detail. Rotor 47 rotates due to actuation of motor 202. Motor 202 is shown in FIG. 19 as connected to the axle of the rotor 47 but may be coupled by any of several operative couplings including, for example, a preferred worm gear arrangement as set forth in copending application Ser. No. 08/422,155 entitled Single Motor Setting and Printing Postage Meter, assigned to the same assignee as the assignee of the present application and incorporated herein by reference. The axle may preferably be the hollow axle set forth in copending application Ser. No. 08/421,900 entitled Postage Meter with Hollow Rotor Axle, assigned to the same assignee as the assignee of the present application and incorporated herein by reference.

In addition to cam 44, there is also provided a slotted disk **44*c* coupled with the rotor axle. Disk 44*c* is optically coupled with LED-phototransistor sensor 50*a*. Sensors 50 and 50*a* provide logic-level signals via lines 209 and 210 respectively to the processor 251. Processor 251 has a control line 203 which actuates motor drive circuitry 206. Motor drive circuitry 206 supplies power to motor 202 via line 204. Those skilled in the art will appreciate that drive circuitry 206 may be pulse-width-modulated drive circuitry, so that line 203 may be a signal indicative of the desired motor direction, and the desired pulse width. A power-fail circuit 205** optionally monitors the incoming AC power to the postage meter and generates a signal to stop the motor drive circuit if imminent power loss is detected.

Figure 20:
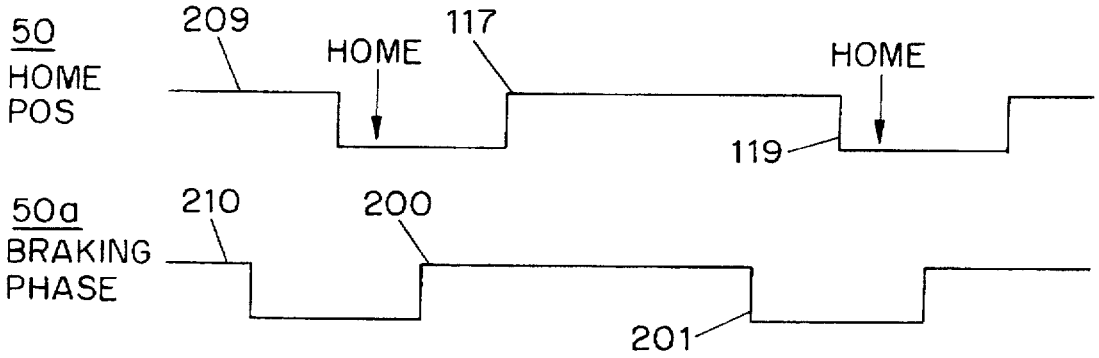
FIG. 20 shows typical signals generated by position sensors in the control loop of FIG. 19.

FIG. 20 shows a typical sequence of outputs from the sensors 50 and **50*a* (on lines 209 and 210) as the rotor proceeds through several revolutions. The home position is shown. As rotation proceeds, first the slotted disk 44*c* breaks the light in sensor 50*a*, so that at 200 the signal is shown rising to an active level. Later, at 117, the cam 44 has caused the follower 44*a* to rise sufficiently that it breaks the light in sensor 50. Rotation continues and at 201 the slotted disk 44*c* causes the signal from 50*a* to drop. This preferably generates an interrupt to the processor to start slowing down the motor 202 so that the rotor may come to a smooth halt. Thus the sensor 50*a* may be thought of as a "braking" interrupt sensor. Finally as the rotor reaches its home position again at 119**, the home position signal again drops.

It will be appreciated that those skilled in the art could devise numerous variations on the configuration of FIGS. 19 and 20 without departing from the invention. In particular, with appropriate modifications the disk **44*c* and associated sensor 50*a*** could be eliminated with software timing or other sensors permitting the slow-down of the rotor.

Figure 21:
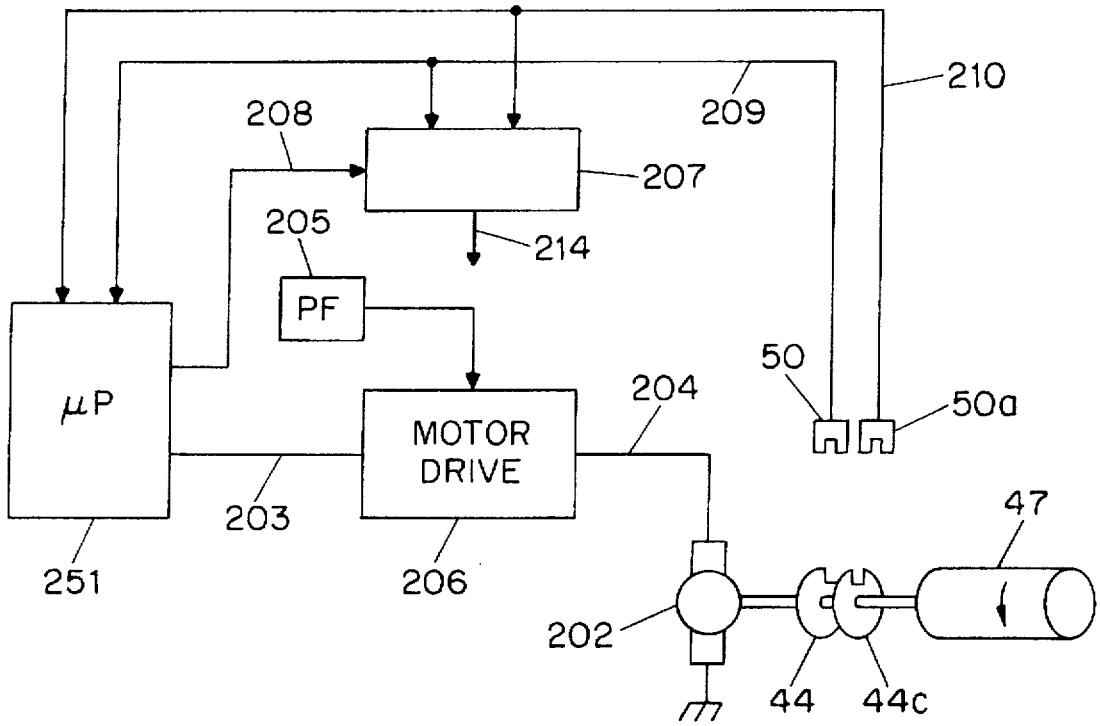
FIG. 21 shows an improved control loop with external circuitry differing from that of FIG. 19, including a monitor circuit 207.

The arrangement of FIG. 19 raises the question what would happen if, after the processor 251 starts the motor 202, the processor 251 were to run amok, for example by inadvertently executing data rather than program code. One concern is that the motor 202 might continue running indefinitely, thus permitting the printing of postage without its being accounted for. Turning now to FIG. 21, there is shown a rotor motion monitor circuit 207 which receives signals 209 and 210 and a reset signal 208, discussed below, from the processor. Under certain conditions the monitor circuit 207 will halt the motor drive circuit 206, just as the power-fail signal from the power-fail detector 205 will halt the drive circuit 206.

Figure 22:
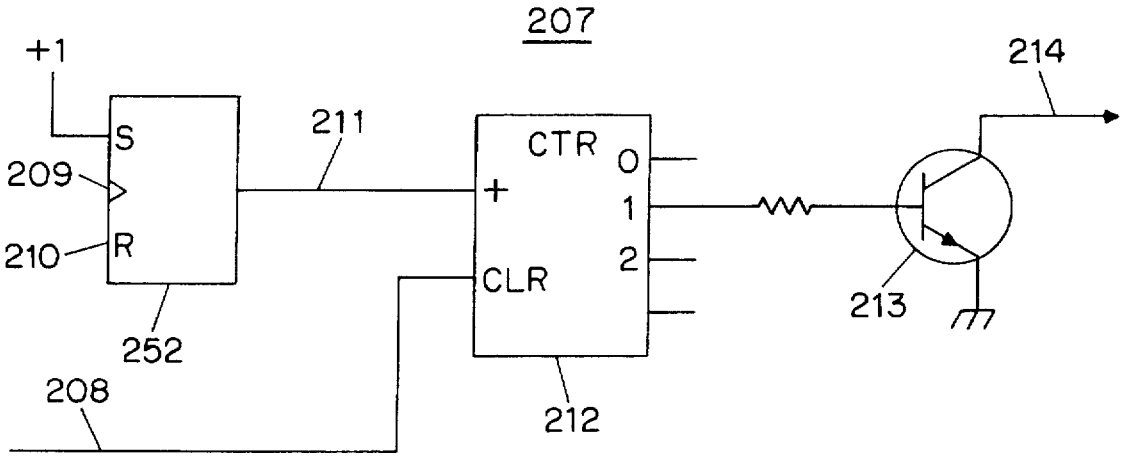
FIG. 22 shows the monitor circuit 207 of FIG. 21 in schematic detail.

Monitor circuit 207 is shown in schematic detail in FIG. 22. The rotor motion signals 209, 210 are provided as reset and clock inputs to flip-flop 252. The resulting signal 211 is a debounced rotor rotation signal 211. Each rising edge of signal 211 is indicative of a rotor revolution taking place. The rising edges are counted in counter 212. In normal software execution the software generates a reset signal 208 once for each franking (postage printing) cycle. Thus, the counter 212 never exceeds a count of one, and in general contains a count of either one or zero.

In the event of processor malfunction, for example the processor running amok, the counter 212 might reach a count of two. In this case, the bit 1 output of the four-bit (0 to 15 counts) counter goes high. This turns on transistor 213, which pulls the power-fail line low through line 214. (The power-fail signal from the power monitor is preferably an open-collector signal.) This halts the motor drive through line 214.

Figure 23:
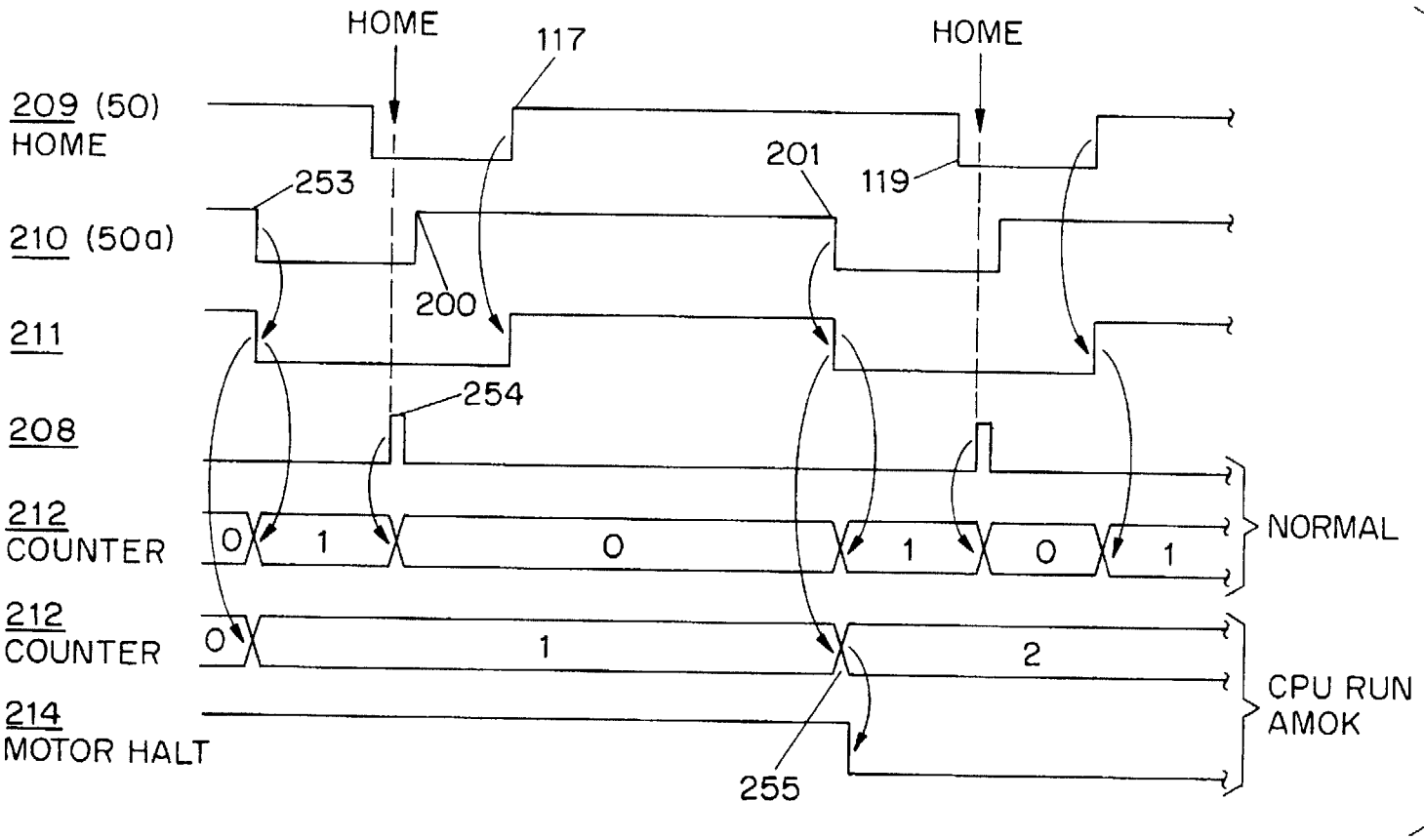
FIG. 23 is a timing diagram showing signals relating to the monitor circuit of FIG. 22.

FIG. 23 shows the timing relationships between the signals in and around monitor 207. The signals of lines 209 and 210, which are inputs to monitor 207, are shown in the first two rows of the figure. At 253 the braking sensor 50*a* drops its output, which causes an increment in the counter 212. The counter had previous contents of zero and now its contents are one. When the rotor reaches its home position at 254, the processor asserts line 208 to resent the counter 212. Assuming normal operation of the processor, this action repeats itself once for each franking.

Now assume a processor malfunction. Then the resetting pulse at 154 does not occur. When the next trailing edge 201 happens, then the counter 212 reaches a count of 2 at 255. This prompts the motor halt signal 214 to be pulled low. The rotor is halted and is kept from rotating indefinitely.

What has been described above is a particular embodiment of the invention, but those skilled in the art can devise numerous obvious variations which fall within the scope of the invention as defined by the claims that follow.

We claim:

1. A method of operation of a postage meter upon application of power, said postage meter comprising a rotor for printing postage value, said rotor defining a home position and having a first sensor indicative thereof, said meter further comprising a secure housing, said rotor contained within said secure housing, said meter further comprising a cover movable between an open position and a closed position, said open position offering access to said rotor, said meter further comprising a second sensor, said second sensor operatively coupled with said cover, said method comprising the steps of:

determining via said first sensor if said rotor is away from said home position;

in the event said rotor is away from said home position, determining via said second sensor if said cover has been opened whilst said rotor has been away from said home position; and in the event said cover has been opened whilst said rotor has been away from said home position, annunciating said condition.

2. The method of claim 1 wherein the annunciating further comprises rendering the postage meter incapable of printing postage value.

3. A method of operation of a postage meter upon application of power, said postage meter comprising a rotor for printing postage value, said rotor defining a home position and having a first sensor indicative thereof, said meter further comprising a secure housing, said rotor contained within said secure housing, said meter further comprising a cover movable between an open position and a closed position, said open position offering access to said rotor, said meter further comprising a second sensor, said second sensor operatively coupled with said cover, said method comprising the steps of:

determining via said first sensor if said rotor is away from said home position;

in the event said rotor is in said home position, doing nothing;

in the event said rotor is away from said home position, determining via said second sensor if said cover has been opened whilst said rotor has been away from said home position; and in the event said cover has not been opened whilst said rotor has been away from said home position, doing nothing;

in the event said cover has been opened whilst said rotor has been away from said home position, annunciating said condition.

4. The method of claim 3 wherein the annunciating further comprises rendering the postage meter incapable of printing postage value.

* * * * *